United States Patent [19]

Hill

[11] 4,082,269

[45] Apr. 4, 1978

[54] PROTECTIVE BASKETBALL HOOP

[76] Inventor: Robert L. Hill, Shandon Star Rte., Paso Robles, Calif. 93446

[21] Appl. No.: 811,547

[22] Filed: Jun. 30, 1977

Related U.S. Application Data

[63] Continuation-in-part of Ser. No. 711,059, Aug. 2, 1976, abandoned.

[51] Int. Cl.[2] ..... A63B 63/02

[52] U.S. Cl. ..... 273/1.5 R

[58] Field of Search ..... 273/1.5

[56] References Cited

U.S. PATENT DOCUMENTS

| | | | |
|---|---|---|---|
| 1,544,453 | 6/1925 | Harbison | 273/1.5 R |
| 2,579,312 | 12/1951 | Garvey | 273/1.5 R |
| 3,181,849 | 5/1965 | Mitchell | 273/1.5 R X |
| 3,313,539 | 4/1967 | Michael | 273/1.5 R |
| 3,565,427 | 2/1971 | Michael | 273/1.5 R |

*Primary Examiner*—Paul E. Shapiro

*Attorney, Agent, or Firm*—Francis X. LoJacono, Sr.

[57] ABSTRACT

A protective basketball hoop comprising a metal rim of sufficient diameter to receive a basketball therethrough and having fixedly circumfused substantially about the rim a net-supporting body member of the plastic material. The net-supporting body includes an integrally formed, depending, annular rib member, or members. That is, the rib can be formed as a continuous circumferential rib or a plurality of equally spaced rib members arranged to have molded therein the upper strands of the netting material. The basketball hoop has secured thereto in a well-known manner a mounting bracket, whereby the hoop and net are affixed to a backboard.

13 Claims, 7 Drawing Figures

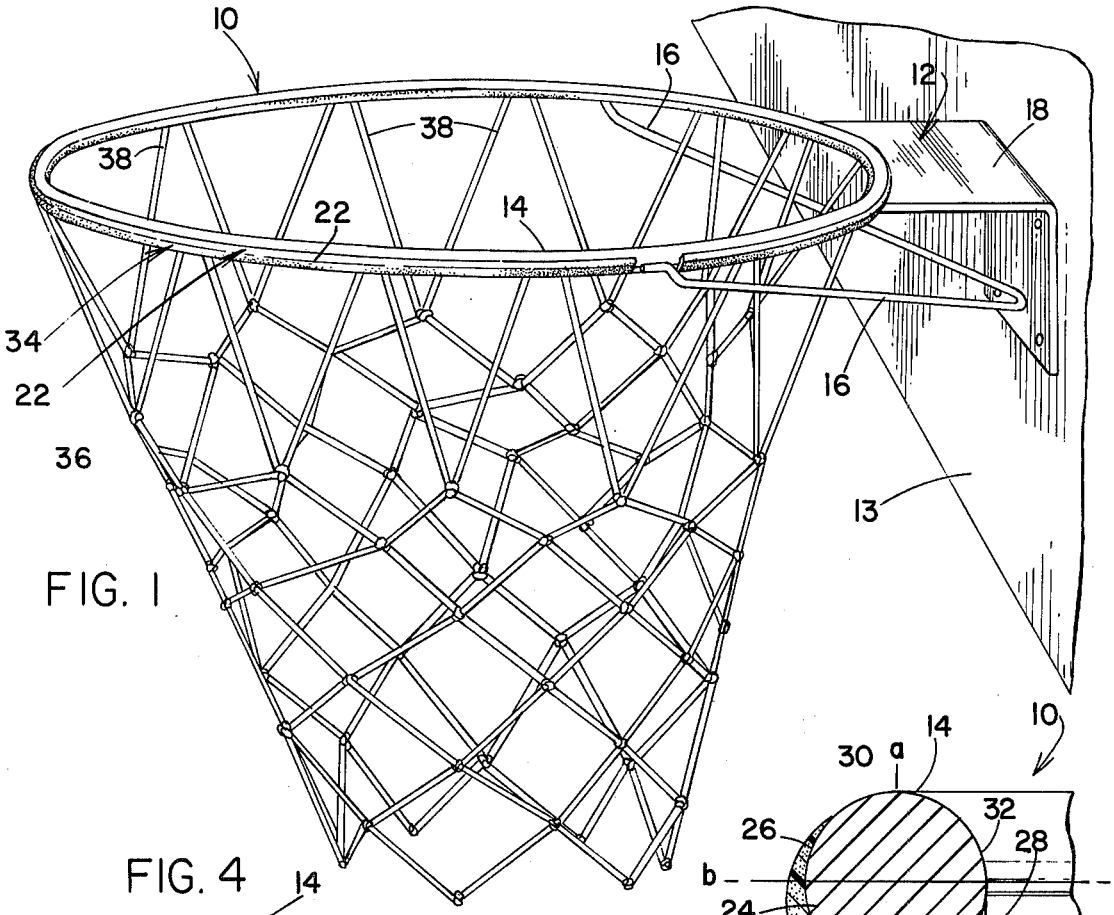
FIG. 1
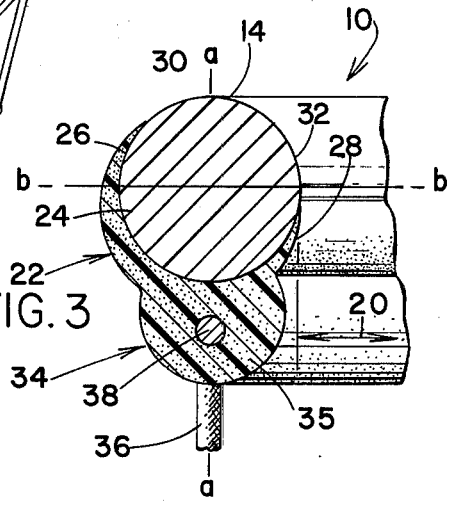
FIG. 3
FIG. 4
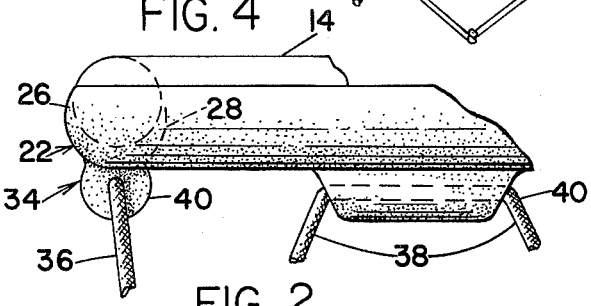
FIG. 2
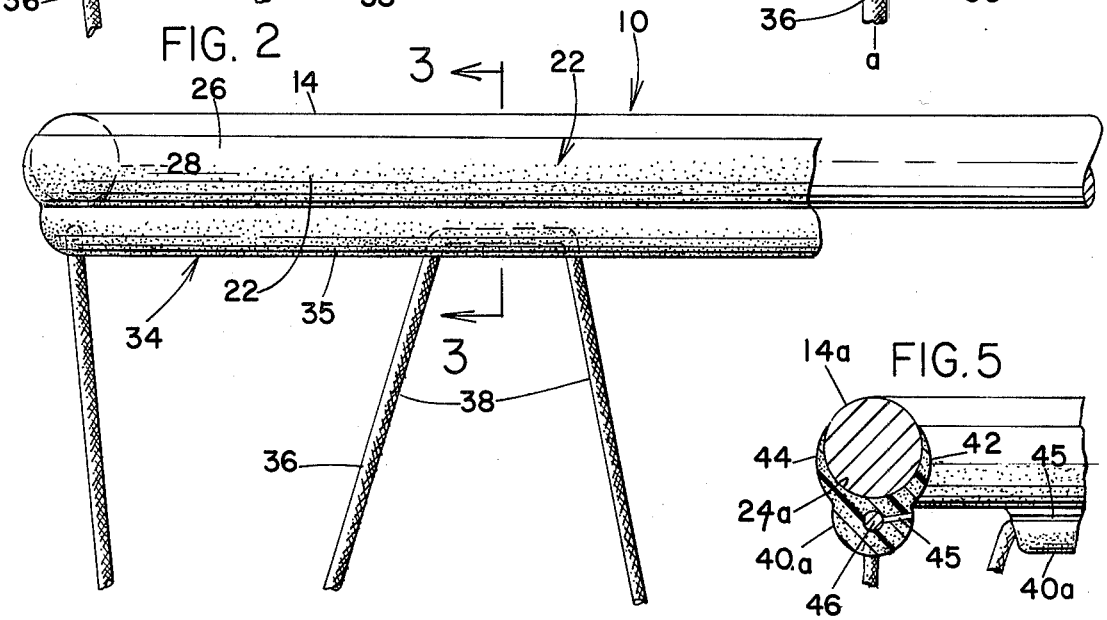
FIG. 5

PROTECTIVE BASKETBALL HOOP

CROSS-REFERENCE

This application is a continuation-in-part of the following abandoned application:

Inventor: Robert L. Hill
Ser. No. 711,059
Filed: Aug. 2, 1976.

BACKGROUND OF THE INVENTION

1. Field of the Invention

This invention relates generally to a basketball hoop and, more particularly, to a basketball hoop incorporating a unique net-supporting device for mounting the basketball netting thereto.

2. Description of the Prior Art

As is well known in the art, several problems and difficulties are encountered in providing suitable means for mounting basketball netting to the basket hoop.

Various types of basketball hoops and nets have been tried and are in use today. However, the most common type of hoop in use on schools, colleges and in professional competetive sports comprises a metal hoop having an inside diameter of eightteen inches, to which there is secured a typical mounting bracket so as to be readily mounted to what is generally referred to as a "backboard".

Affixed, generally by welding, are a plurality of metal wire loop members that are arranged to depend downwardly from the under annular portion of the hoop member. Each wire loop member is bent back on itself, providing a hook to allow the upper looped strands of the net to be individually and removably supported over the formed hooks.

Accordingly, during game play there is a tendency for the looped strands to become disengaged from the hooks, causing delay in the game proceedings while the disconnected net is being fixed. In addition, the continuous movement of the net causes the supporting strands to wear since the net is freely attached to the rim hooks. These are some of the problems encountered during play or practice sessions.

Another more serious problem occurs when a player is reaching for the ball or making a shot at the basket rim. That is, when the player has jumped from the playing floor — and has his arms, hands and fingers stretched upwardly — a finger or a ring can be caught in the looped support wire, possibly causing great bodily harm.

Also, because of the greater height of the present-day athlete, a player's head can be brought into contact with the underside of the metal basket rim while he is jumping for the ball under the net.

There is also a problem when a player wears a long ornamental neck chain. This, too, has caused serious injury to players with the well known basketball hoop presently in use.

Thus, the present herein-disclosed invention is so designed as to overcome such inherent problems of the past.

SUMMARY OF THE INVENTION

The present invention comprises a protective basketball hoop having a circumferential metal rim formed with the inside diameter of eighteen inches to comply with college and professional playing rules.

The rim includes an annular, depending, net-supporting body member molded about a given portion of the peripheral surface of the rim so as to be formed as an integral part of the rim, the support being formed from any suitable material such as plastic, hard rubber, etc., that will allow the upper looped portions of the basketball not to be integrally formed thereto, whereby all previous protruding elements or fixtures are eliminated thereby. The net-supporting body is formed about the lower half or two-thirds of the peripheral surface of the rim member in a continuous circumfused manner.

Depending from the body is an integrally formed, depending, annular rib in which the upper strands of the net are molded therein. In the preferred embodiment, the rib is cast as a single, continuous, annular member having the strands of the net intermittently secured thereto. A second embodiment comprises a plurality of equally spaced rib members arranged at particular points along the supporting body to receive the net loops therein.

As is usually the case, there is attached to the rim a backboard mounting bracket which is secured to the rim in such a manner as not to interfere with the molded support body.

OBJECTS AND ADVANTAGES OF THE INVENTION

The present invention has for an important object a provision wherein all protruding fixtures or elements are eliminated from the basketball hoop, whereby accidental injury to a player is completely prevented.

It is another object of the invention to provide a protective basketball hoop that has the basketball netting formed as an integral part thereof so as to prevent any disconnetion of the net during game play.

It is still another object of the present invention to provide a protective basketball hoop of this type that complies with the all requirements under the college and professional game regulations.

It is a further object of the invention to provide a device of this character that is simple and easy to service, maintain and replace.

A further object of the invention is to eliminate the wear of the net loops caused by constant movement of the nets.

A still further object of the invention is to provide a device of this character that is relatively inexpensive to manufacture.

Other characteristics, advantages and objects of this invention can be more readily appreciated from the following description and appended claims. When taken in conjunction with the accompanying drawings, this description forms a part of the specification wherein like references and characters designate corresponding parts in several views which are as follows.

BRIEF DESCRIPTION OF THE DRAWINGS

Referring more particularly to the accompanying drawing, which are for illustrative purposes only;

FIG. 1 is a perspective view of the protective basketball hoop showing it mounted in the well known manner to a backboard;

FIG. 2 is an enlarged, fragmentary, side-plan view thereof;

FIG. 3 is an enlarged, cross-sectional view taken along line 3—3 of FIG. 2 showing a strand of netting molded in the depending annular rib member;

FIG. 4 is an alternative arrangement wherein there is formed a plurality of sequential rib members; and FIG. 5 is a cross-sectional view showing another embodiment of the present invention.

DESCRIPTION OF THE PREFERRED EMBODIMENT

Figure 6:
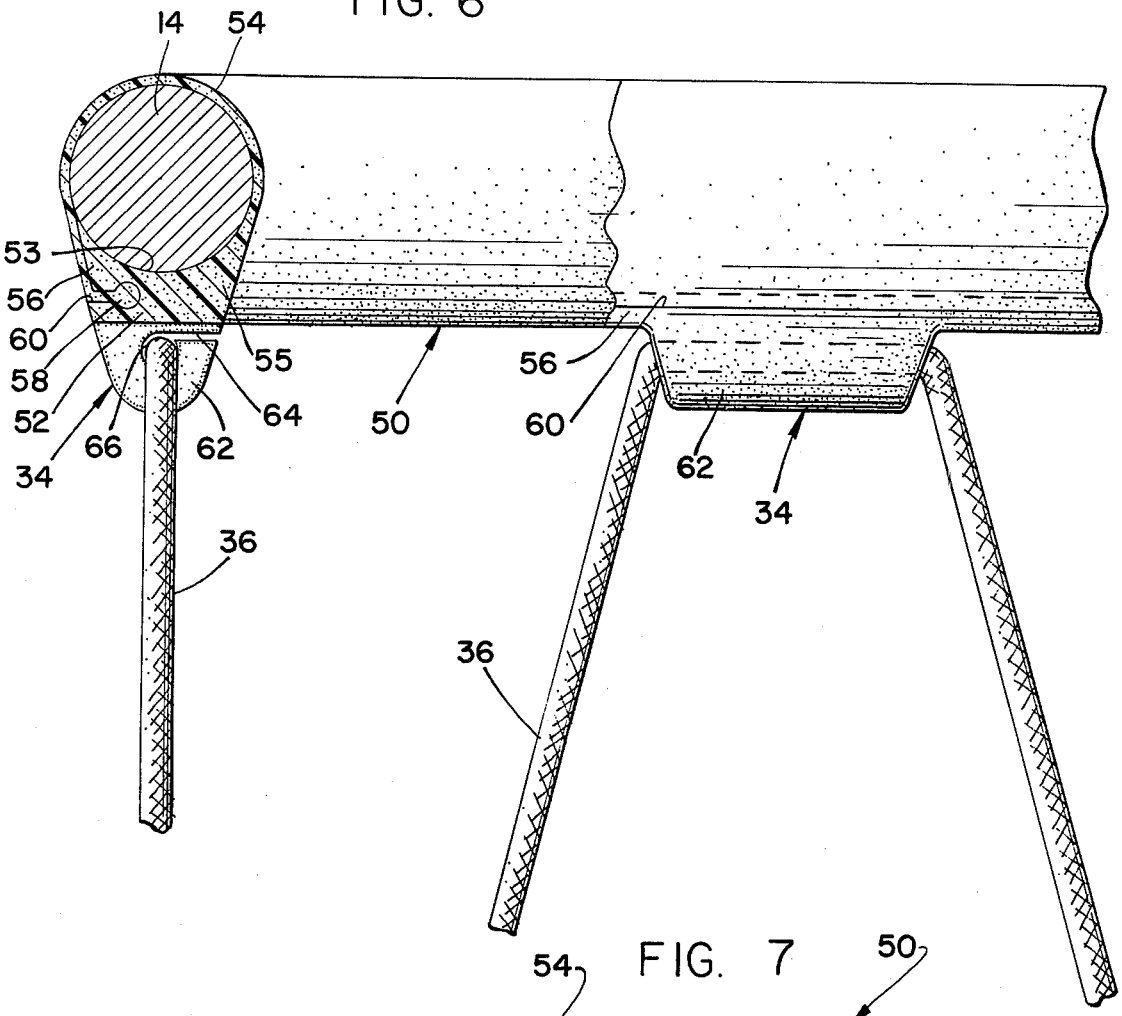

Referring more particulary to FIG. 1, there is shown a protective basketball hoop, generally indicated at 10, having a standard type mounting bracket designated at 12, the bracket being secured to any well known type of backboard 13, whether it be made of wood or clear glass-like material.

The bracket 12 is generally welded to the metal circular ring-like rim 14, having side supporting frame struts 16 secured between the bent bracket plate 18 and rim 14.

At this point, it should be understood that various strict requirements must be met when constructing the various basketball equipment. In this case, the annular ring rim 14 must have an inside diameter of eighteen inches, the inside diameter being indicated by line and arrow 20 in FIG. 3.

The protective hoop 10, therefore, comprises rim 14 having a net-supporting body 22 circumfused about the entire substantially lower portion of the annular rim 14. The only interruption of the support body may take place at the bracket connections, as seen in FIG. 1. The net-support body comprises a continuously formed channel member 24, the channel being defined by crescent-shaped annular walls 26 and 28.

The outer wall 26 is arranged to cover the outer peripheral surface of the rim 14 up to a point just below the upper central plan 30 indicated at the vertical center line *a—a*. The inside wall 28 terminates just below the horizontal center line *b—b;* thereby no additional thickness is added to the rim at point 32, whereby the inside diameter of the rim remains the required eighteen inches, as previously mentioned.

It is contemplated that support body 22 will be secured to rim 14 by any suitable bonding process. However, it can also be directly molded thereto as the support body is formed.

Integrally formed and depending below the channel member 24 is a net-mounting means, generally indicated at 34, the net-mounting means being formed in this embodiment as a continuous annular rib member 35 having the basketball netting 36 secured thereto, wherein the upper strands 38 of net 36 are molded within the rib member at spaced intervals, as seen in FIGS. 1 and 2.

Referring now to FIG. 4, there is illustrated an alternative arrangement of the net-supporting body 22, wherein the net-mounting means 34 comprises a plurality of short sequentially disposed rib members 40 integrally molded about the lower or bottom portion of the channel member 24. Thus, the upper strands 38 of net 36 are molded in each individual rib member 40, as seen in FIG. 4.

A further embodiment is illustrated in FIG. 5. This embodiment is designed to provide the inner and outer walls 42 and 44, respectively, of channel **24*a*, with equal-sized configurations. That is, inner wall 42 extends further upward identically to the outer wall 44**.

In this arrangement, the rim **14*a* must have a diameter sufficient enough to provide a clear opening having at least an eighteen-inch diameter. Hence, the opening for the basketball to pass through will be determined by the inner wall 42**.

In addition, it is also contemplated that, when the arrangement of having a plurality of depending mounting ribs such as **40*a* is employed, the net can be a separate part thereof and connect to each rib member 40*a* through horizontal slots 45, and thus be received in a longitudinal central bore 46**.

Figure 7:
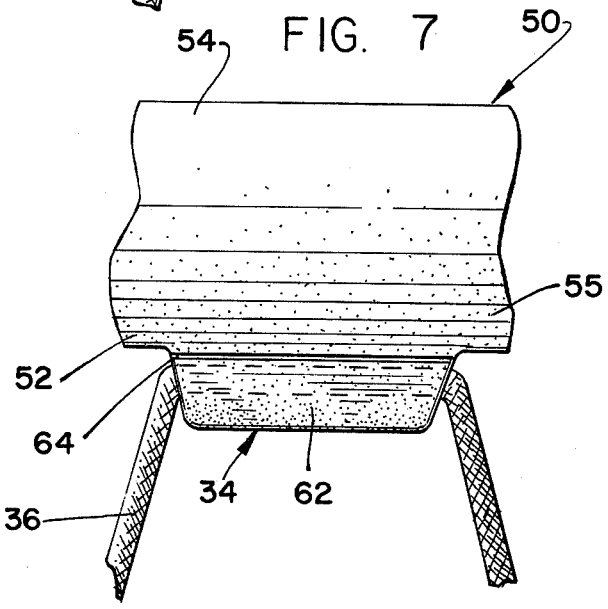

Still another embodiment of the present invention is shown in FIGS. 6 and 7. In this particular arrangement, rim 14 is totally enclosed within a net-supporting body, generally indicated at 50.

Net-supporting body 50 comprises a lower base portion 52, wherein the inner upper wall 53 adjacent the rim 14 is formed having a continuous arcuate channel to receive rim 14 therein, the radius of said channel being substantially the same as that of rim 14, whereby rim 14 fits snugly therein. The base member 52 is integrally formed with an overlapping cover member 54, and is arranged to be an extension of the inner peripheral side wall 55 of base member 52. The cover is provided with a sufficient width so as to further cover and overlap a substantial portion of the outer peripheral side wall 56 of the base member, wherein cover member 54 is secured to said base member — thereby enclosing the rim 14.

A securing means comprising a peripheral rib member, formed along the free edge of said cover 54, is locked into an annular slot 60, slot 60 being formed in the outer peripheral side wall 56 of base 52. This arrangement is clearly shown in FIG. 6.

In both FIGS. 6 and 7, the net-mounting means 34 is shown as having a plurality of depending mounting ribs 62, such as hereinbefore described, wherein each depending rib 62 is integrally formed as part of base member 52 and includes horizontal slots or openings 64, wherein slots 64 extend inwardly — thus terminating in a longitudinal bore 66. Hence, the net 36 can be mounted and supported in bores 66 of each rib 62.

However, it should be understood that the arrangement of net-mounting means 34 can also be a continuous annular rib member, such as 35 in FIGS. 2 and 3.

The invention and its attendant advantages will be understood from the foregoing description, and it will be apparent that various changes may be made in the form, construction and arrangement of the parts of the invention without departing from the spirit and scope thereof or sacrificing its material advantages, the arrangement hereinbefore described being merely by way of example, and I do not wish to be restricted to the specific form or uses mentioned, except as defined in the accompanying claims.

I claim:

1. A protective basketball hoop having a netting formed from a plurality of strands and a mounting bracket, wherein said protective hoop comprises:
   - an annular rim member attached to said mounting bracket;
   - an annular net-supporting body circumfused substantially about the peripheral portion of said rim member; and
   - net-mounting means integrally formed to said net-supporting body, wherein said net is mounted thereto.

2. A protective basketball hoop as recited in claim 1, wherein said net-supporting body comprises an annular channel member, wherein said rim member is received therein, said channel member being defined by an inner wall member and an outer wall member.

3. A protective basketball hoop as recited in claim 2, wherein said net-mounting means comprises at least one depending rib member wherein the strands of the netting are secured therein.

4. A protective basketball hoop as recited in claim 3, wherein said strands are molded within said rib member in a spaced relationship to each other.

5. A protective basketball hoop as recited in claim 3, wherein a plurality of individual rib members are formed along the bottom portion of said supporting body member in a sequentially spaced manner having said net secured thereto.

6. A protective basketball hoop as recited in claim 5, wherein each of said rib members includes:

a horizontal slot therein; and a longitudinal bore arranged to communicate with said slot and to allow the strands of said net to be secured within said bore.

7. A protective basketball hoop as recited in claim 4, wherein said net-supporting body is bonded to said annular rim member.

8. A protective basketball hoop as recited in claim 4, wherein said net-supporting body is directly molded to said annular rim member.

9. A protective basketball hoop as recited in claim 2, wherein said net-mounting means comprises a continuous, annular, depending rib member formed about the lower peripheral portion of said net-supporting body, wherein strands of the netting are molded therein.

10. A protective basketball hoop as recited in claim 1, wherein the net-supporting body comprises:

a base member having a continuous arcuate channel formed therein to receive said rim member;

an overlapping cover member integrally connected to one side of said base member and secured to the opposite side of said base member; and securing means formed between said cover member and said base member.

11. A protective basketball hoop as recited in claim 10, wherein said securing means comprises:

an annular-edge rib member integrally formed in said cover member; and an annular slot formed in one side of said base member, whereby said rib member is locked therein to secure said net-supporting body to said rim member.

12. A protective basketball hoop as recited in claim 11, wherein said net-mounting means comprises at least one depending rib member, wherein the strands of the netting are secured.

13. A protective basketball hoop as recited in claim 12, wherein a plurality of individual rib members are formed along the bottom portion of said base member in a sequentially spaced manner having said net mounted thereto.

* * * * *